US006793377B2

(12) United States Patent
Chu

(10) Patent No.: US 6,793,377 B2
(45) Date of Patent: Sep. 21, 2004

(54) LAMPSHADE WITH REDUCIBLE PACKAGE VOLUME

(76) Inventor: Hak Kee Chu, Room 404, Nam Fung Commercial Centre, 19 Lam Hing Street, Kowloon Bay (HK)

( * ) Notice: Subject to any disclaimer, the term of this patent is extended or adjusted under 35 U.S.C. 154(b) by 19 days.

(21) Appl. No.: 10/243,808

(22) Filed: Sep. 13, 2002

(65) Prior Publication Data

US 2003/0107896 A1 Jun. 12, 2003

(30) Foreign Application Priority Data

Dec. 11, 2001 (CN) ..... 01278051

(51) Int. Cl.[7] ..... F21V 1/06

(52) U.S. Cl. ..... 362/350; 362/352; 362/356; 362/357

(58) Field of Search ..... 362/351, 352, 362/356, 357, 358

(56) References Cited

U.S. PATENT DOCUMENTS 2,516,286 A * 7/1950 Yeidel ..... 362/357
2,713,632 A * 7/1955 Fine ..... 362/357
6,386,739 B1 * 5/2002 Wu ..... 362/356
6,439,747 B1 * 8/2002 Liu et al. ..... 362/358
6,443,599 B1 * 9/2002 Wu ..... 362/351
6,443,600 B1 * 9/2002 Wu ..... 362/351

* cited by examiner

*Primary Examiner*—Laura K. Tso
(74) *Attorney, Agent, or Firm*—Greer, Burns & Crain, Ltd.

(57) ABSTRACT

A lampshade with reducible package volume according to the present invention relates to the improvement in the support structure of the lampshade, including a lampshade enclosure with a supporting ring arranged on the upper and lower sides thereof, on said supporting ring at one side is fixed a first mounting frame, at least two ends of said supporting ring at one side is provided with a curved part turning toward the interior of the lampshade, and at least a supporting pole having at least a curled edge part clipped in between the curved part of said mounting frame and the enclosure, and at least a supporting arm part with its end fixed on the supporting ring at the other side. The lampshade according to the present invention is easy to assemble and simple in structure, and has a fixed lampshade structure after its assembling. The outlook of the lampshade can be changed according to the shapes of the supporting ring, and is therefore rich in style.

11 Claims, 8 Drawing Sheets

LAMPSHADE WITH REDUCIBLE PACKAGE VOLUME

FIELD OF THE INVENTION

The present invention relates to a lampshade, especially to a lampshade with improved support structure and reducible package volume.

BACKGROUND OF THE INVENTION

At present, lampshades in use are mounted beforehand with fixed structures and cannot b e dismantled willfully, occupying thus a large volume and being liable to damages during transportation. Therefore, foldable or dismountable lampshades were patented as early as in 1960's. An invention disclosed in Chinese patent ZL. 97 2 15059.5 as shown in FIG. 1 has a plurality of eyes on two supporting rings of the lampshade, and a plurality of top hooks are arranged on the ends of each single-cylindrical supporting pole for hooking up said eyes, so that the supporting poles can be removed during transportation to reduce the whole package volume. However, the combination of the supporting poles, the top hooks and the eyes is of a type of the so-called two-terminal hinge-supported lanky cylinder according to the principles of mechanics of materials. Its reactive force doesn't go through the pole's cross-sectional area, therefore the whole framework is unstable in that the supporting pole can rotate freely about its axis and the upper and lower supporting rings can have relative movements with each other in their own planes, making thus the lampshade structure complex and unable to easily dismantle or mount. Also, the upper and lower supporting rings are monotonous in style, limited only to either a circular or an elliptical ring.

A lampshade with a reducible package volume is also known from the U.S. Pat. No. 3,023,307 as shown in FIG. 2, which utilizes a U-shaped snap fastener 101 to realize the connections between the mounting frames and the supporting rings and between the supporting rings and the supporting poles for supporting the whole lampshade, the mounting frames and the supporting poles being able to be dismantled during the transportation to reduce the package volume. Although the hinge support problem was solved by doing so, the structure of the manufactured lampshade and the procedures for its assembly became complicated because of the complexity in manufacturing the U-shaped snap fasteners of the lampshade. Moreover, the vulnerability of the connection of the U-shaped snap fastener with the mounting frame and the supporting pole made the lampshade more vulnerable.

Another disadvantage of said prior art lampshades lies in that their structural designs violated scientific principles, e.g. in said Chinese patent, the reactive force doesn't go through the pole's cross-sectional area when the two-terminal hinge-supported lanky cylinder is used as a supporting pole. In said U.S. patent, although a two-terminal fixedly supported supporting pole is used, it should be made as a curved one to suit to an inwardly curved lampshade, this directly going counter to the principles of the mechanics of materials and decreasing greatly the supporting force of the lanky pole.

SUMMARY OF THE INVENTION

One objective of the present invention is to provide a lampshade with a reducible package volume, wherein the improved mounting frame structure lies in that the fixed end of the mounting frame leg and the supporting ring has a lampshade-inward curved part, and the U-shaped supporting pole has a curled edge part on its closed supporting end, which is clipped in between the curved part of said mounting frame leg and the lampshade enclosure, and the assembly of the lampshade can be realized simply by hooking up the two hooks of the U-shaped supporting pole into the eyes of the supporting ring at the other side.

Another objective of the present invention is to provide a lampshade, wherein straight cylindrical supporting arms are used as force undertaking components to support lamp shades with a straight line profile and an inwardly curved profile based on the principle of a cylindrical surface formation according to geometry so that the reactive force goes through the supporting cross-sectional area to conform with the requirement of principles of mechanics of materials, wherein U-shaped components are used instead of single-cylindrical supporting poles to increase the number of the contact points between the supporting components and the two supporting rings from 2 to more than 3, decrease the degrees of freedom of the movement between the supporting components and the two supporting rings, and increase thus the strength of the whole structure, and wherein the supporting components can be used as the supporting components for a bulged lampshade based on the principle of an arch.

The objectives are realized according to the present invention by providing a lampshade with reducible package volume, including a lamp enclosure, on its upper and lower sides are arranged a supporting ring respectively, wherein a first mounting frame is provided on said supporting ring at one side, at least two ends connected therewith are arranged with a curved part turning toward the interior of the lampshade, and at least a supporting pole, having at least a curled edge part which is clipped in between said curved part of the mounting frame and said lamp enclosure, and at least a supporting arm part, its ends being movably fixed with said supporting ring at the other side.

Said lampshade, wherein eyes are provided on corresponding positions on said another supporting ring, and the ends of said supporting arm part are curved to form hooks to hook up with said eyes.

Said lampshade, wherein the ends of said supporting arm part are formed as forks fixed on said supporting ring at the other side.

Said lampshade, wherein said supporting pole has two U-shaped supporting arm parts, and the distance there between is larger than the distance between two eyes.

Said lampshade, wherein said first mounting frame has at least two ends and a mounting ring at its center.

Said lampshade, wherein the ends of said supporting arm part has a second curled edge part, and a second mounting frame is fixed on said supporting ring at the other side, at least two ends connected with said supporting ring at the other side are provided with lampshade-inward curved parts to clip said second curled edge part in between the curved part of said second mounting and the lamp enclosure.

Said lampshade, wherein said second mounting frame has at least two ends and a mounting ring at its center.

Said lampshade, wherein said lower supporting ring is larger than the upper supporting ring.

Said lampshade, wherein said lamp enclosure has elasticity.

The lampshade according to the present invention has a simple structure, a fixed lampshade form after its assembling, a lampshade outlook which can be changed according to the form of the supporting ring, and is therefore rich in style since a lampshade-inward curved part is provided between the supporting legs of the mounting frame and the connection ends of the supporting ring, and a curled edge part is provided accordingly at the closed supporting ends of the U-shaped supporting pole so that, when in assembly, said curled edge part is clipped in between the curved part of the supporting leg and the lamp enclosure, and the two hooks of the U-shaped pole are hooked up into the eyes of the supporting ring at the other side.

BRIEF DESCRIPTION OF THE DRAWINGS

The technical scheme of the present invention and its advantages will become more evident when it is described in more details through the illustration of the preferred embodiments according to the present invention with reference to the drawings, in which.

DETAILED DESCRIPTION OF PREFERRED EMBODIMENTS

Figure 1:
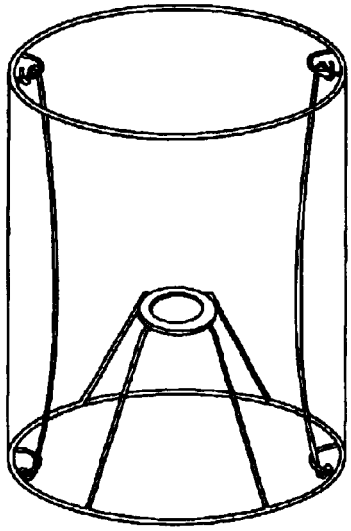
FIG. 1 is a schematic diagram of the prior art lampshade.
Figure 2:
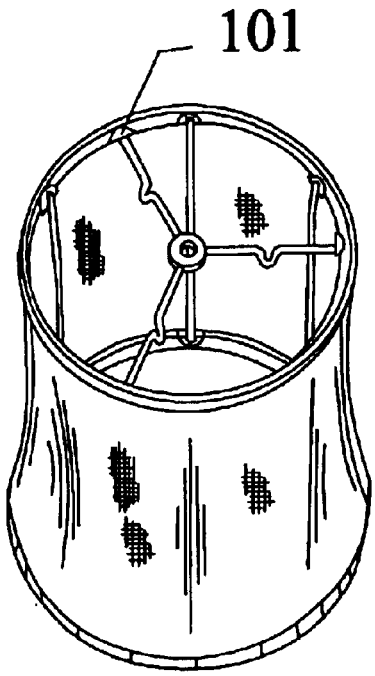
FIG. 2 is a schematic diagram showing another example of the prior art.
Figure 3A:
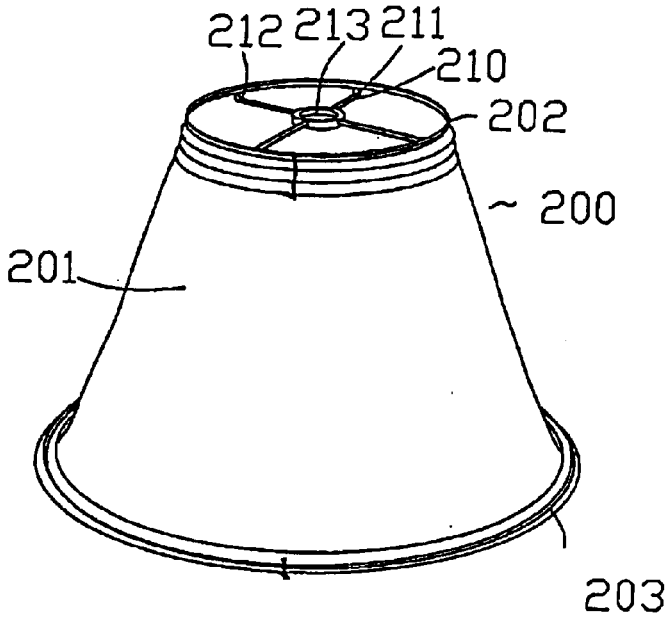
FIGS. 3A and 3B are perspective schematic diagrams in upper and lower directions showing the lampshade with a reducible package volume according to the present invention.
Figure 3B:
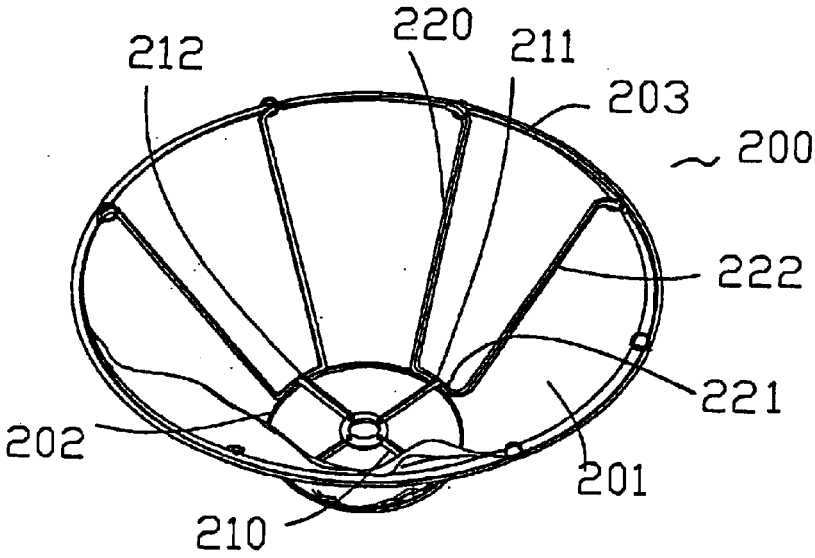
Figure 4A:
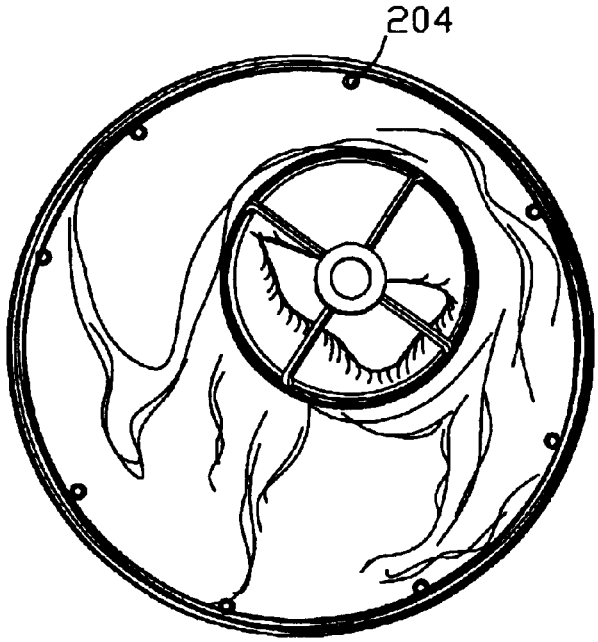
FIG. 4A is a schematic diagram showing the state of the lampshade according to the present invention before its disassembling and packaging.
Figure 4B:
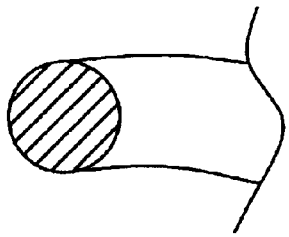
FIG. 4B, FIG. 4C and FIG. 4D are schematic diagrams showing respectively different sections of three kinds of supporting rings.
Figure 4C:
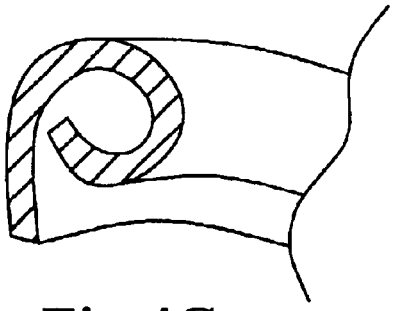
Figure 4D:
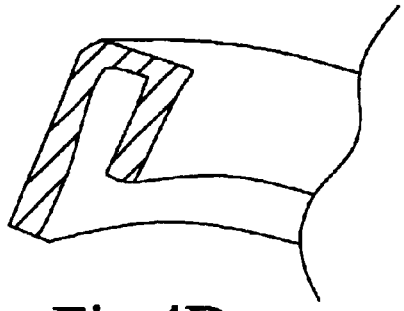

As shown in FIG. 3A and FIG. 3B, a lampshade 200 with reducible package volume according to the present invention has a lampshade enclosure 201, on its upper and lower parts are arranged respectively a supporting ring 202 or 203, which can be the rings made of solid metal wires sewed into the upper and lower edges of said enclosure 201, or the rings molded with plastic materials as shown in FIG. 4B, FIG. 4C and FIG. 4D; and a first mounting frame leg 210 is fixed on a supporting ring at one part, e.g. the supporting ring 202 at the upper part said first mounting frame leg 210 and said supporting ring 202 connecting with at least two curved first connecting ends 211 and 212 configured for turning toward the lampshade interior; the first mounting frame leg 210 preferably includes a central ring 213. Meanwhile, at least a straight supporting pole 220 having at least one curled edge part 221 can be clipped in between the curved part or end part 211 of said first mounting frame leg 210 and the lampshade enclosure 201 upon assembly; and at least a pair of supporting arm parts 222 are arranged on said at least one supporting pole 220 to support and fix the other supporting ring 203 so that the whole supporting pole is of a U shape.

In the case of a noncircular cross-sectional area of the supporting ring as shown in FIG. 4D, because of the action of the gravity, the supporting arm part 222 of said supporting pole 220 is necessarily only required to be hanged on the turning position of said other supporting ring 203; however, such a case is not applicable when said clipping structure is arranged on the supporting ring 203 at lower part, since the supporting pole in such a situation is unable to clip on the supporting ring because of the same gravity action, resulting in a loosened lampshade.

Figure 5A:
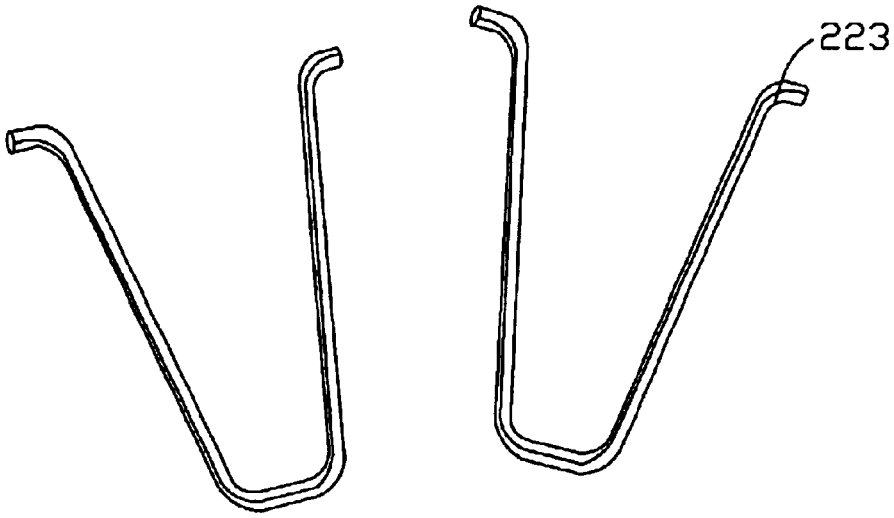
FIGS. 5A and 5B are schematic diagrams showing respectively the forms of a supporting pole suitable for the use in the lampshade according to the present invention of FIG. 3A.
Figure 5B:
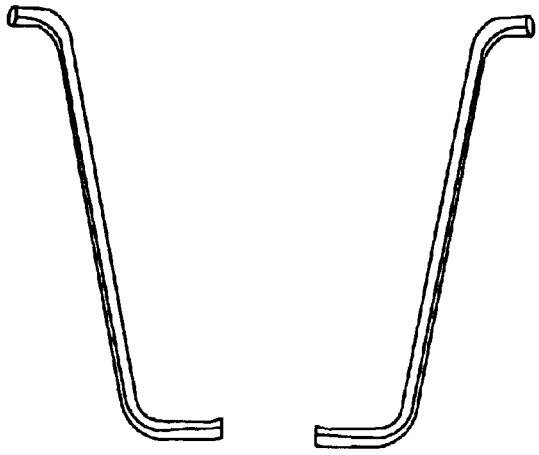
Figure 5C:
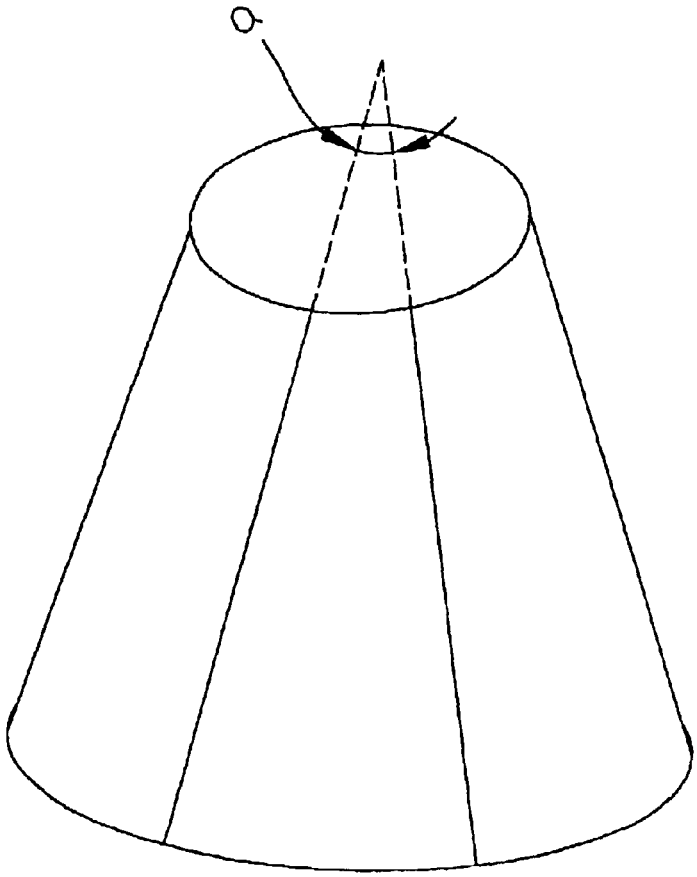
FIG. 5C is a schematic diagram showing two generatrices of the lampshade surface with a straight-line profile.
Figure 5D:
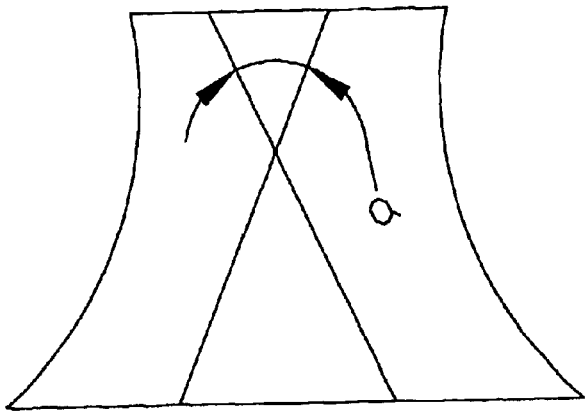
FIG. 5D is a schematic diagram showing two generatrices of the lampshade surface with a lampshade-inward curved profile.

Nevertheless, a simpler hookup structure can be utilized at the other end of said supporting arm part 222. As shown in FIG. 4A, a plurality of pairs of eyes 204 with a uniform distance slightly smaller than the distance between the U-shaped open ends are arranged on the supporting ring 203, and a second of at least one connecting ends forming a second curled edge part of the supporting arm part 222 of the corresponding said supporting pole 220 are curled to form hooks 223 to support and fix powerfully said supporting ring 203 as shown in FIG. 5A. In FIG. 5A, an angle is formed between two supporting arm parts 222, which is the angle between the two generatrices on the lampshade surface when the lampshade has a straight line profile as shown in FIG. 5C, and it becomes the angle between two symmetrical generatrices on the lampshade surface with lampshade-inward curved profile as shown in FIG. 5D, i.e. the two crossed generatrices in such a case are moved to form the two arms of the U-shaped supporting pole. Of course, the present invention can have other variations for its supporting pole such as that shown in FIG. 5B, which employs two separate supporting poles having a curled edge part and a supporting arm part instead of the U-shaped supporting pole of FIG. 5A. This is especially suitable to the case of plastic supporting rings, since in such a case it is easy to make various breaches or bulges on supporting rings, and this also can meet the objectives of the present invention.

Figure 6:
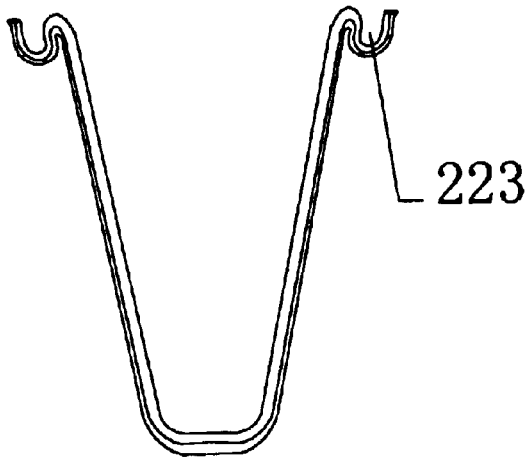
FIG. 6 is a variation of the supporting pole of the lampshade according to the present invention.

The ends of the supporting arm part 222 of said supporting pole 220 has also other variations. As shown in FIG. 6, the hook can be further curved to form a fork 224. Although it may require more manufacturing procedures, its assembled structure will be more robust, and the assembly of the lampshade can be realized only by fork up the fork 224 on the supporting ring without the need of the eye 204.

In a lampshade 200 according to the present invention, a mounting ring is arranged at the center of said first mounting frame 210 for mounting the lampshade on the lamp post over the lamp bulb as shown in FIG. 3A.

Figure 7A:
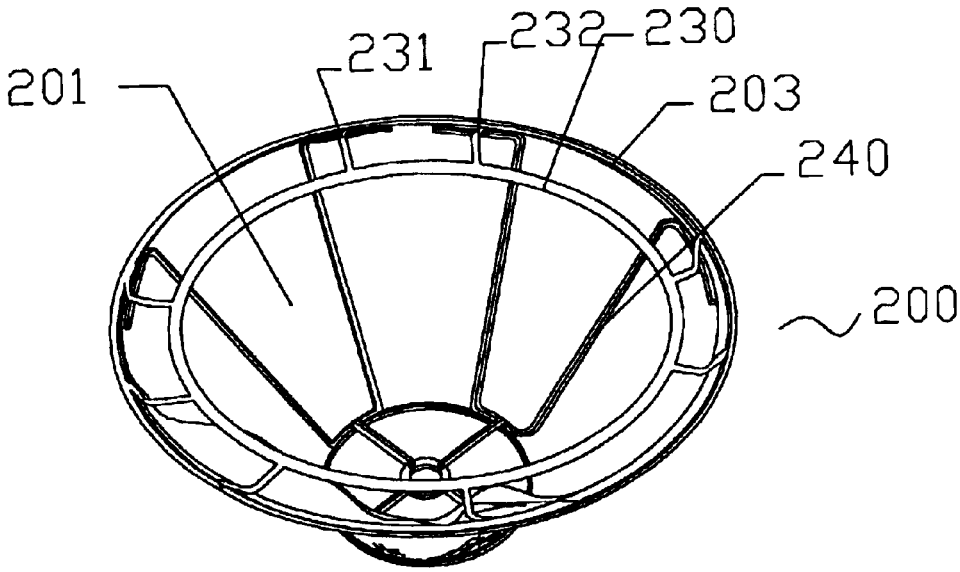
FIG. 7A is a perspective schematic diagram showing another preferred embodiment of 15 the lampshade according to the present invention.
Figure 7B:
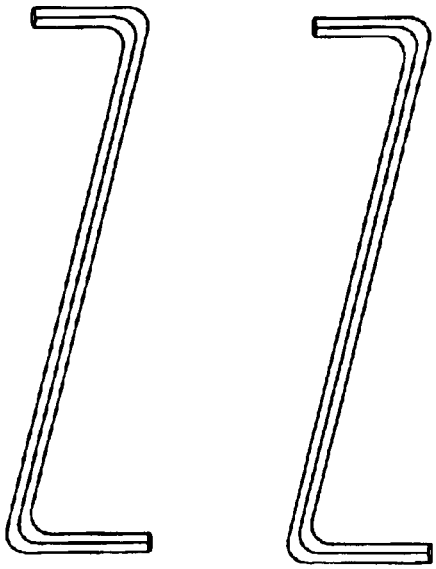
FIGS. 7B and 7C are diagrams showing two preferred embodiments of the supporting pole of the lampshade of FIG. 7A.
Figure 7C:
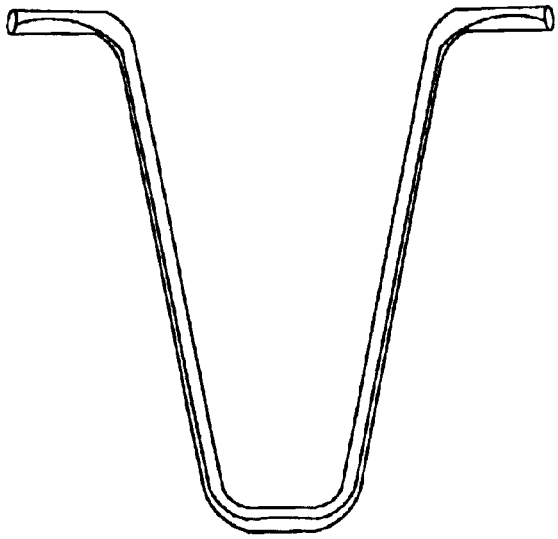

In a lampshade 200 with reducible package volume according to the present invention as shown in FIG. 7A, more preferably a same structure can be arranged on the supporting ring at the lower part i.e. a second mounting frame 230 is fixed on said supporting ring 203, which has at least two ends 231, 232 connected with said supporting ring 203, and a lampshade-inward curved part is provided on the connecting end, forming thereby a clipping groove with the lampshade enclosure. A supporting pole 240 is disposed accordingly, its end for connecting with said curved part is also a curled edge part as shown in FIGS. 7B and 7G. The supporting pole can be of a "Z" shape or an inverted "U" shape with its two ends clipped into the groove formed by mounting frames inside the upper and lower supporting rings and the enclosure to realize a simple assembly and a solid support for the lampshade.

Of course, a mounting ring can be provided inside the second mounting frame 230. But the mounting ring is slightly smaller than the supporting ring 203 and is used only for fixing its connecting ends.

Moreover, the enclosure of the lampshade is of elasticity, and can form an arc alongside the lampshade after being assembled. The elasticity is necessary for the enclosure in that the supporting pole can become bulged or inwardly-curved so that different shapes of lampshade like those of a bulged enclosure or an inwardly-curved enclosure can be realized.

In a lampshade with reducible package volume according to the present invention, the supporting ring at the upper side can be smaller than the supporting ring at the lower part but is not limited thereto, also the shapes of the supporting rings 202 and 203 cannot be limited to those shown in the diagrams. Any necessary shapes such as rectangular or triangular shapes are possible so that lampshades with different shapes are possible, and all those changes or variations should be within the scope of the present invention as set forth in the appended claims.

Figure 8A:
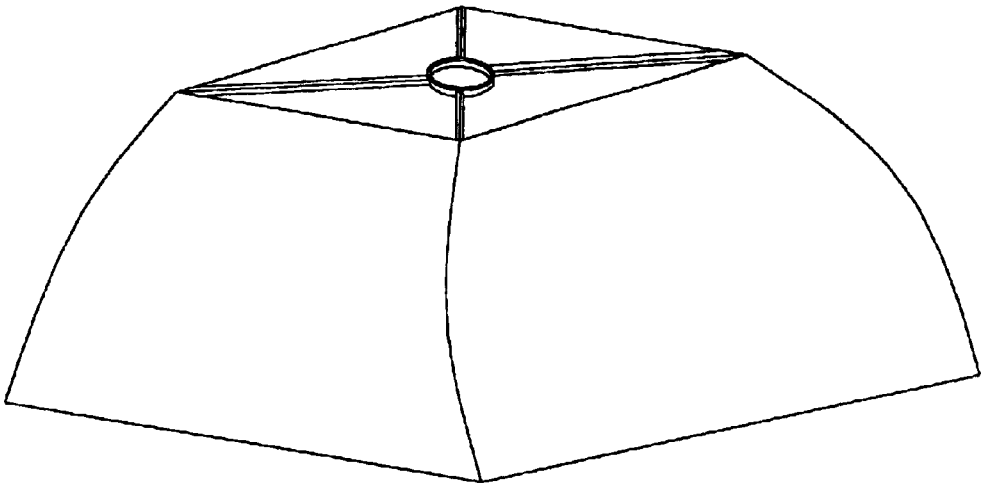
FIG. 8A, FIG. 8B and FIG. 8C are schematic diagrams showing the outlook of the lampshade with rectangular bulged profile and two supporting poles.
Figure 8B:
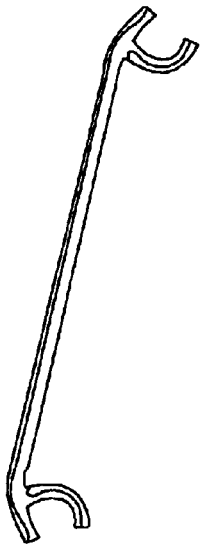
Figure 8C:
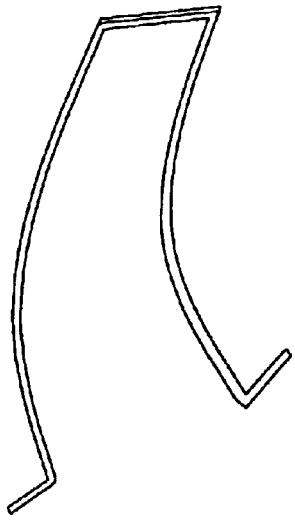

FIG. 8A, FIG. 8B and FIG. 8C show the outlook of a lampshade according to the present invention with a rectangular bulged profile and their supporting components. Since the lamp shades of this technical field also should conform to the safety requirements, a distance between bulb and lampshade is therefore defined in the U.S. Safety Standards. If a straight-line profile is adopted, the lampshade will be made very large, costing too much and having an unpleasing outlook. Therefore the lampshade with bulged profile has been always very popular, e.g. in the Chinese palace lanterns and in the pumpkin-shaped lanterns in other countries. The present invention employs the rectangular bulged profile as an example for the illustration in order to cover all possible bulged profiles. In the lampshade with bulged profile, since the supporting pole should be in contact with the enclosure, rustproof measures such as applying epoxy resin etc. should be taken for the metal part of the supporting pole. The single supporting pole in FIG. 8B is used for an turning position, and the U-shaped supporting pole used as the supporting pole for the middle part of each plane also has its corresponding radians.

What is claimed is:

1. A lampshade with reducible package volume, including a lampshade enclosure with a supporting ring arranged on its upper and lower parts respectively, characterized in that a first mounting frame is fixed on said supporting ring at one of said upper part or lower part of said lampshade, at least two connecting ends of said first mounting frame connected with a first said supporting ring are provided with a curved part turning toward the interior of the lampshade, and at least one supporting pole, having at least one curled edge part clipped in between the curved part of said mounting frame and said enclosure, at least a pair of supporting arm parts having ends being movably fixed a to a second said supporting ring at the other side, and the end of said at least one pair of supporting arm parts has a second curled edge part, and a second mounting frame is fixed on said second supporting ring at the other part, at least two ends connected with said supporting ring at the other part being provided with a curved part turning toward the interior of the lampshade so that said second curled edge part can be clipped in between the curved part of said second mounting frame and said enclosure.

2. A lampshade according to claim 1, characterized in that a plurality of eyes are arranged at the corresponding positions on said supporting ring at the other side, and the ends of said supporting arm part are curled to form hooks for hooking up with said eyes.

3. A lampshade according to claim 1, characterized in that the ends of said supporting arm part are formed into forks to be forked up on the supporting ring at the other side.

4. A lampshade according to claim 2, characterized in that said supporting pole has two U-shaped supporting arm parts, and the distance between the two supporting arm parts is larger than that between the two corresponding eyes.

5. A lampshade according to claim 4, characterized in that said first mounting frame has at least two ends with a mounting ring at its center.

6. A lampshade according to claim 1, characterized in that said second mounting frame has at least two ends with a mounting ring at its center.

7. A lampshade according to claim 2, characterized in that said supporting ring at the lower side is larger than said supporting ring at the upper side.

8. A lampshade according to claim 7, characterized in that said enclosure is made of elastic material.

9. A lampshade according to claim 3, characterized in that said supporting pole has two U-shaped supporting arm parts, and the distance between the two supporting arm parts is larger than that between the two corresponding eyes.

10. A lampshade according to claim 3, characterized in that said supporting ring at the lower side is larger than said supporting ring at the upper side.

11. A lampshade according to claim 6, characterized in that said supporting ring at the lower side is larger than said supporting ring at the upper side.

* * * * *